US007059358B2

(12) United States Patent
Ogiwara

(10) Patent No.: US 7,059,358 B2
(45) Date of Patent: Jun. 13, 2006

(54) OPEN-ENDED BASE FABRIC FOR PAPERMAKING PRESS FELT AND PAPERMAKING PRESS FELT

(75) Inventor: Yasuyuki Ogiwara, Tokyo (JP)

(73) Assignee: Ichikawa Co., LTD, Tokyo (JP)

( * ) Notice: Subject to any disclaimer, the term of this patent is extended or adjusted under 35 U.S.C. 154(b) by 236 days.

(21) Appl. No.: 10/374,822

(22) Filed: Feb. 25, 2003

(65) Prior Publication Data

US 2004/0159362 A1 Aug. 19, 2004

(30) Foreign Application Priority Data

Feb. 25, 2002 (JP) ..... 2002-047736

(51) Int. Cl.
*D21F 3/00* (2006.01)

(52) U.S. Cl. ..... 139/383 A; 139/383 AA; 162/358.1; 162/900

(58) Field of Classification Search ..... 139/383 AA, 139/383 A; 162/358.1, 900, 902–904
See application file for complete search history.

(56) References Cited

U.S. PATENT DOCUMENTS 4,601,785 A 7/1986 Lija et al. ..... 162/199
4,870,998 A * 10/1989 Westhead ..... 139/383 A
5,913,339 A * 6/1999 Lee ..... 139/383 AA
6,079,454 A * 6/2000 Lee et al. ..... 139/383 AA
6,273,146 B1 * 8/2001 Herring ..... 139/383 AA
6,273,147 B1 * 8/2001 Herring ..... 139/383 AA
6,289,940 B1 * 9/2001 Herring ..... 139/383 AA
6,318,413 B1 * 11/2001 Herring ..... 139/383 AA
6,378,566 B1 * 4/2002 Kornett ..... 139/383 AA
6,835,284 B1 * 12/2004 Kornett ..... 162/358.2

FOREIGN PATENT DOCUMENTS

JP 59-112091 6/1984
WO WO 99/16965 4/1999

* cited by examiner

*Primary Examiner*—John J. Calvert
*Assistant Examiner*—Robert H Muromoto
(74) *Attorney, Agent, or Firm*—L.C. Begin & Associates, PLLC

(57) ABSTRACT

The object of the present invention is to provide an open-ended base fabric for a papermaking press felt wherein the shape of seam loops are retained to facilitate the mounting operation of the press felt.

The object is achieved by an open-ended base fabric for papermaking press felt, comprising a continuous MD thread in the MD direction disposed in each layer constituting both surfaces of the base fabric and CD threads in the CD direction interwoven with the MD thread to connect each layer, the continuous MD thread forming a loop portion for inserting a seam thread at both ends of the base fabric, wherein said base fabric is provided with a control thread along each end edge of the CD thread arrangement, said control thread being interwoven in a different weave pattern from that of the CD thread in the base fabric, and said control thread urges a MD thread near both ends not to deviate in the outward direction and/or the CD direction so that the shape of said loop portion for inserting a seam thread is retained.

15 Claims, 18 Drawing Sheets

(A)

(B)

OPEN-ENDED BASE FABRIC FOR PAPERMAKING PRESS FELT AND PAPERMAKING PRESS FELT

DETAILED DESCRIPTION OF THE INVENTION

1. Technical Field of the Invention

The present invention relates to a felt for use in the press section of papermaking machinery, and more particularly to an open-ended base fabric for a papermaking press felt having seam loops.

2. Prior Art

Conventionally, in the press step of paper making process, a needled felt and a couple of press rolls have been used for the dewatering of wet paper.

An open-ended felt having seam loops shown in FIG. 1 is known as this type of needled felt. To be specific, the felt F is configured to be open-ended and a plurality of seam loops L are formed at each end.

The felt F is comprised of, for example, a base fabric B formed of a fabric and two layers of batts W as shown in FIG. 2. The batt layers W are formed by integrating the base fabric B and fibrous webs placed thereon by needle punching.

The base fabric B is formed by interweaving MD (machine direction) threads and CD (cross direction) threads. And the seam loops L are formed of the MD threads.

To put it into operation, the open-ended felt F is mounted on the roll in a papermaking machine and the both ends of the felt are brought together to fit a loop at one end into between loops at the other end so that the loops at the both ends are engaged.

In this engaging operation, first the loops on each end are brought together not in a head-on relation but at an angle as shown in FIG. 2 (A), and thereafter the loops are brought into engagement. Thus, when fitting the loops at one end into between the loops at the other end, a loop at one end is supposed to be fitted from bottom to top into between loops at the other end. For this engaging operation, a specially designed jig is used, but details of which are omitted.

Upon completion of the engaging operation, a tunnel is formed of a row of the loops L with an opening, and a seam thread S is inserted into the tunnel-like hole formed of the loop openings as shown in FIG. 2(B). Then, the both ends of the felt joined at an angle are flattened to form an endless papermaking press felt F.

This type of felt F is generally called as a "loop seam felt" and its use has been increasing in recent years because of the ease of the mounting operation (JP-A-S59-112091).

An open-ended felt F has two surfaces each of which having a width in the CD direction and a length in the MD direction and the both surfaces constitute an outer and inner surfaces when the felt is transformed from an open-ended state to an endless state. To be specific, the outer surface constitutes a contact surface with wet paper and the inner surface constitutes a contact surface with the press roll.

Thus, when the word "surface" is used regarding the parts constituting the felt F in this specification, it indicates the both surfaces which come into contact with the wet paper and the press roll, i.e., the inner surface and the outer surface of the "part" when the felt is in an endless sate. In this specification, the word "inward" indicates the direction viewing the felt from outside to inside including directions from the outer surface and the inner surface of the felt. Also the word "outward" means the two directions viewing the felt from its inside to the both surfaces.

Now, the structure and the manufacturing process of the base fabric B will be described referring to FIGS. 3 to 6. FIG. 3 shows a schematic view of one end of the base fabric B. In this figure, the base fabric B consists of the CD threads 1 and the MD threads 2. FIG. 3 shows a ⅓ warp double weave structure and FIG. 4 shows a ½ warp double weave structure. It is needless to say that any form of the structure may be selected without being limited to these structures.

The MD thread 2 is folded back repeatedly at ends to form a pair of upper and lower structures. Specifically, the MD threads 2 disposed parallel in a plane form a layer and thereby each surface of the base fabric B is jointly formed of the surfaces of the threads in each layer.

The CD threads 1 are arranged in the CD direction in an arbitrary form to connect the layers of the MD thread 2.

In this configuration, the loops L are formed of the folded parts of the MD thread 2 which protrude away from the CD thread 1 located in the extreme end.

Next, the process of manufacturing the base fabric B will be described referring to FIGS. 5 and 6.

FIG. 5 is a schematic diagram to show an example of the manufacture by a double-weaving loom. The double-weaving loom is not shown here since its structure is well known.

In this scheme, the CD thread 1 is selected as the warp thread which is moved up and down by a heddle and the MD thread 2 is selected as the weft thread which is interwoven through the travel of a shuttle respectively.

And a seam thread S, which is a fiber thicker than the CD thread, is disposed as a warp thread at each extreme end.

From here on, the operation of the well-known double-weaving loom will be briefly described. First, the warp threads are selectively moved by the heddle and then a shuttle which contains the weft thread travels through the space created between the moved and unmoved warp threads to dispose the weft thread in the space. After the travel of the shuttle, the heddle is driven to hold the weft thread between the warp threads. Thereafter, a lead is driven to press the weft thread into between the warp threads. These operations are repeated to form a fabric.

FIG. 6 is a schematic diagram to show the sequence of the shuttle travel. That is, as described above, the shuttle moves back and forth between the both ends of the loom to dispose the weft thread.

As shown in the figure, first the shuttle travels in the direction (1). In this configuration, the seam thread S is disposed as a warp thread at an extreme end of the direction of the shuttle travel. Thus, the shuttle passes through S arriving at the end of the loom and, at this moment, the seam thread S is moved by the heddle so that the shuttle passes over the seam thread S.

Then the shuttle turns back at S and travels in the opposite direction (2). At this time, the seam thread S is moved so that the shuttle passes under the seam thread S.

Again, the shuttle travels in the direction (3) to dispose the weft thread over the seam thread S and further travels in the direction (4) to dispose the weft thread under the seam thread S.

During this process, the warp threads are selectively moved by the heddle forming two groups: one to hold the weft thread in the directions (1) and (2), and the other to hold the weft thread in the directions (3) and (4). These series of operations are repeated until a desired width of the felt in the CD direction is achieved.

Upon achieving the desired CD width, the base fabric is taken out of the loom and the seam thread S is drawn out to complete an open-ended base fabric having loops L at both ends.

As described above, the MD threads 2 shown as a parallel arrangement in FIGS. 3 and 4 are actually formed by disposing a continuous weft thread in a spiral form. And each of the outer and inner peripheral surfaces of the base fabric B is formed by the weft threads in the directions (1) and (4) and the weft threads in the directions (2) and (3) respectively.

However, in the case of the above described conventional loop structure, there was some difficulty in inserting the seam thread S into the loops during the mounting operation of the felt.

Now, the first example of the prior art will be described based on FIGS. 7 to 10.

FIG. 7 shows a cross sectional view taken along the CD direction at an end of the base fabric B showing the outline of the construction. The figure is a cross sectional front view at one end of the base fabric B in which the loop L is sectioned. Though the MD threads 21A to 24B are shown in a cross section taken at the root of the loops L; it will be recognized that, in actuality, the MD thread 21A connects with 21B, likewise 22A with 22B, 23A with 23B, and 24A with 24B, each pair forming a loop L respectively.

FIG. 7 shows the structure of the base fabric B, which is a ⅓ warp double weave. To show all the patterns of the ⅓ weaving, the CD thread 1 is illustrated in four threads with reference numbers 11 to 14. More specifically, in an end of the base fabric B, the CD thread 11 is placed at the extreme end and other threads 12, 13, 14 are disposed in that order from the outside to the inside of the base fabric B.

As shown in FIG. 3, a loop L is formed of a pair of MD threads located further toward an end of the base fabric than the CD thread 11. The MD thread 2 is fixed with its surface being pressed by the CD thread 1, and therefore, the shape of the loop L mainly depends on the CD thread 1.

Now, referring to the schematic diagram shown in FIG. 8, the effect of the CD threads 11 and 12 on the MD threads will be described. In this figure, the arrows indicate force vectors acting on each MD thread and being urged by the CD threads 11 and 12.

That is, the MD threads 21A and 23B are held between the CD threads 11 and 12. The MD threads 21A and 23B are urged slantwise outwardly by the CD thread 12, while they are urged inwardly by the CD thread 11. In this configuration, the CD threads 11 and 12 are adjacent to each other canceling out each other''s vector, and therefore, the MD threads 21A and 23B are disposed in the base fabric B at a position where their surfaces are pressed by the CD thread 11.

In a similar fashion, the MD threads 22A and 24B are held between the CD threads 11 and 12. These MD threads 22A and 24B are urged inwardly by the CD thread 12 and, away from this position, the urging force from the outside is released; however, they are then urged slantwise outwardly to the surface by the CD thread 11. These urging force vectors are mostly cancelled out since the CD threads 11 and 12 are close to each other.

Thus the MD threads 22A and 24B are disposed in the base fabric B at the positions where they are pressed by the CD thread 12.

In this configuration, the outer surfaces of the MD threads 21B, 22B, 23A, 24A are free from the urging force in a region outside of the positions of the CD thread 11 and the adjacent CD thread 12 thereto, both of which are threads at an extreme end. That is, though the MD threads 22B and 24A are urged inwardly by the CD thread 13, thereafter they are configured to be urged slantwise outwardly by the CD thread 11 and then released.

Similarly, though the MD threads 21B and 23A are urged inwardly by the CD thread 14, thereafter they are urged slantwise outwardly by the CD thread 12 and then released.

Therefore, as shown in FIG. 9, the MD threads 23A and 24A are disposed in the base fabric B at further outward positions than the MD threads 21A and 22A, and similarly the MD threads 21B and 22B than the MD threads 23B and 24B respectively.

Since a pair of upper and lower MD threads constitute a loop as described above, the loop L2 formed of the MD threads 21A and 21B would consequently become offset in the vertical direction from the loop L1 formed of the MD threads 23A and 23B as shown in FIG. 10.

Next, a second example of the prior art will be described referring to FIGS. 11 to 14.

FIG. 11 shows a cross sectional view of the ⅓ warp double weave fabric which has a different CD thread configuration from that of the base fabric B described in FIG. 7.

In this case, as shown in FIG. 12, the MD threads 21A, 23B are urged inwardly by the CD thread 11, and similarly the MD threads 21B and 23A by the CD thread 12 respectively.

On the other hand, the MD threads 22A, 24A, 22B, 24B are urged outwardly by the CD threads 12 and 11.

As a consequence of this, the MD threads are actually disposed as shown in FIG. 13. That is, the loop L1 formed of the MD 21A and 21B and the loop L2 formed of the MD 22A and 21B would have openings of different sizes as shown in FIG. 14.

A third example of the prior art will be described referring to FIGS. 15 to 19. FIG. 15 shows a ½ warp double weave fabric which has a different fabric structure from that of the base fabric B shown in FIGS. 7 and 11.

The MD threads 21A, 24A, 23B are urged by the CD thread 11 through their top and side surfaces.

Force vectors acting on, for example, the MD thread 21A are shown in FIG. 17. That is, due to the force vector exerted by the CD tread 11, the MD thread 21A is subject to a resultant force vector having components in the CD direction (rightward in the figure) and in the inward (downward in the figure) direction.

Based on the same principle, all the MD threads 2 each of which constitutes the root portion of a loop L are subject to the above described force vector exerted by the CD thread 1 respectively as shown in FIG. 16. That is, the MD threads 2 at the root portions of the loops L would consequently be disposed with a deviation in the CD direction as shown in FIG. 18. As described above, the MD thread is subject to a force vector in "the CD and inward direction" and in actuality the "force vector in the CD direction" is more dominant due to the factors such as the contact of the MD thread with the slope of the CD thread.

Therefore, the actual shapes of the loops L would become skewed in the CD direction as shown in FIG. 19.

As shown in the examples 1 to 3 of the prior art, in the case of conventional loop structures, the positions of the root portions of the loops are not stabilized with respect to the base fabric B.

Therefore, there was difficulty in engaging the loops at each end of the papermaking press felt and also in smoothly inserting the seam thread S into the hole formed of the loops.

The Problem to be Solved by the Invention

Accordingly, it is the object of the present invention to solve the above described problems by providing an open-ended base fabric for a papermaking press felt which retains an appropriate shape of the seam loops to facilitate the mounting operation of the press felt.

Means for Solving the Problems

The inventors of the present invention have conducted eager investigations and found that the above described problems can be solved by further adding a control thread along each end edge of the CD thread arrangement in an open-ended base fabric to retain the MD threads near the both ends at predetermined positions, and further continued the investigation to eventually complete the present prevention.

Thus the present invention relates to an open-ended base fabric for a papermaking press felt, comprising a continuous MD thread disposed in the MD direction on each layer constituting both surfaces of the base fabric and CD threads in the CD direction interwoven with the MD thread to connect each layer, said continuous MD thread forming a loop portion for inserting a seam thread at both ends of the base fabric, wherein said base fabric is provided with a control thread along each end edge of the CD thread arrangement, said control thread being interwoven in a different weave pattern from that of the CD thread in the base fabric, and said control thread urges the MD threads near both ends of the base fabric not to deviate in the outward direction and/or the CD direction so that the shape of said loop portion for inserting a seam thread is retained.

The present invention also relates to the above described open-ended base fabric for a papermaking press felt, characterized in that said control thread is arranged to inwardly urge a MD thread which is inwardly urged neither by a first CD thread located at an extreme end of the CD thread arrangement nor by a second CD thread adjacent to said first CD thread.

The present invention further relates to the above described open-ended base fabric for a papermaking press felt, characterized in that said control thread cancels out a force vector in the CD direction which is exerted by a CD thread and acts on a MD thread near both ends of the base fabric.

The present invention also relates to the above described open-ended base fabric for a papermaking press felt, characterized in that said control thread is separately arranged for each layer of the MD thread.

The present invention further relates to the above described open-ended base fabric for a papermaking press felt, characterized in that each control thread arranged separately for each layer has a different thickness.

The present invention also relates to the above described open-ended base fabric for a papermaking press felt, characterized in that said control thread is disposed in any of the layers of the MD thread.

The present invention further relates to the above described open-ended base fabric for a papermaking press felt, characterized in that said control thread is arranged to connect each layer of the MD thread.

The present invention also relates to the above described open-ended base fabric for a papermaking press felt, characterized in that said control thread is a fiber which is thinner than the CD thread.

The present invention further relates to the above described open-ended base fabric for a papermaking press felt, characterized in that said control thread is a type of fiber which is flattened as it is bent.

The present invention also relates to a papermaking press felt, comprising the above described open-ended base fabric for a papermaking press felt.

The open-ended base fabric for a papermaking press felt according to the present invention can facilitate the mounting operation of the press felt because the MD threads near the loops thereof are placed stably in the predetermined positions without deviating in the outward direction or in the CD direction, and thereby a normal shape of the loops is retained.

DESCRIPTION OF SYMBOLS

Figure 1:
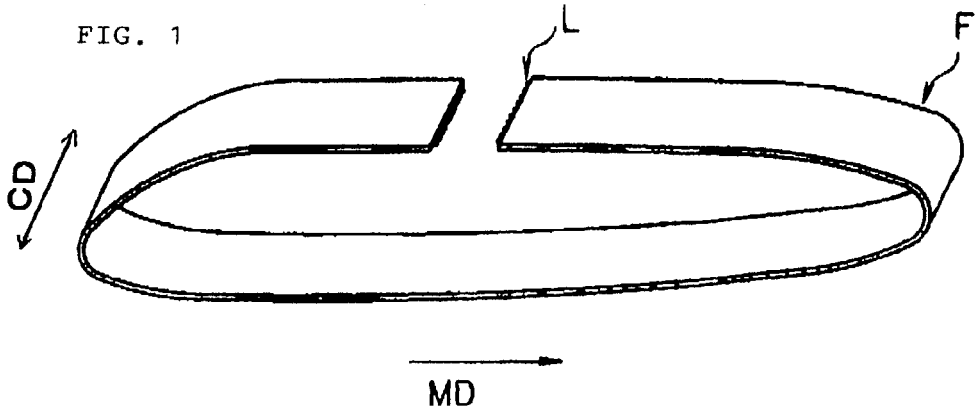
FIG. 1 shows a schematic view of an open-ended papermaking press felt.

F felt
B base fabric
L loop
W batt
S seam thread
1 CD thread
2 MD thread
3 control thread
11 to 14 CD threads
21A to 24B MD threads
d deviation of loop
? slope of loop

EMBODIMENTS OF THE INVENTION

The open-ended base fabric for a papermaking press felt of the present invention is configured such that control threads, which are woven along the end edges of the CD thread arrangement in a different weave pattern from that for the CD threads in the base fabric, urges the MD threads close to the both ends thereof against the deviation in the outward direction and/or in the CD direction. Therefore, the weaving pattern for the control thread may be of any type as long as it urges the MD threads close to the both ends thereof against the deviation in the outward direction and/or in the CD direction.

Particularly to urge the MD thread against the deviation in the outward direction, it is preferable to arrange the control thread so as to inwardly urge MD threads which are inwardly urged neither by a first CD thread placed at an extreme end of the CD thread arrangement nor by a second CD thread adjacent to the first CD thread.

The embodiments of the present invention in accordance with the above described configuration will be specifically described referring to practical examples shown in FIGS. 20 to 31; these examples are shown by way of explanation and are not intended to limit the present invention.

The first embodiment will be described referring to FIGS. 20 to 24. This embodiment is intended to solve the problem of a ⅓ warp double weave fabric as described in FIGS. 7 to 10.

In the figure, the numeral 3 denotes the control thread disposed in the CD direction. Specifically, the control thread 3 is disposed closer to the end of the base fabric than the CD thread 11 which is located in an extreme end of the CD thread arrangement constituting the base fabric B. Thus, the control thread 3 is disposed at the root portions of the loops.

The control thread 3 is arranged at the root portions of the loops such that it inwardly urges the MD threads which are urged neither by a first CD thread 11 located in an extreme end of the CD thread arrangement constituting the base fabric B nor by a second CD thread 12 adjacent to the first CD thread (hereinafter referred to as "float MD thread").

Figure 21:
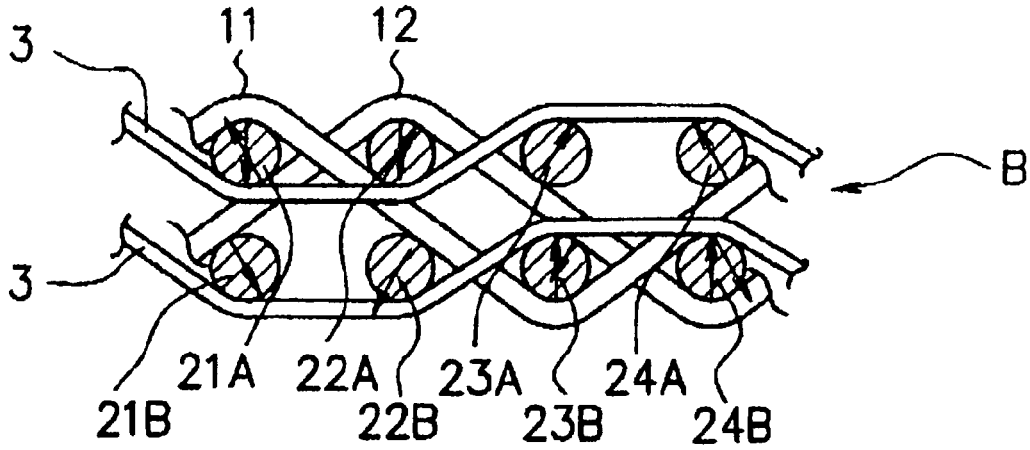

For example, in the layer of MD threads 21A, 22A, 23A, 24A constituting an outer surface of the base fabric, an arrangement may be made such that the control thread 3 passes under the MD threads 21A, 22A which are urged inwardly by the CD threads 11 and 12, and passes over the float MD threads 23A, 24A as shown in FIG. 21.

By this arrangement, the float MD threads 23A, 24A are urged inwardly and the float MD thread 23A is pressed against and held by the side surface of the CD thread 12 and likewise, the float MD thread 24A by the side surface of the CD thread 11 respectively. In consequence, the layer of MD threads comprised of the MD threads 21A, 22A, 23A, 24A is disposed at a substantially fixed position in the MD direction.

In an analogous fashion, a control thread 3 is disposed in the layer consisting of the other MD threads 21B, 22B, 23B, 24B. In this case, as in the above described case, the float MD threads are urged inwardly by the control thread.

In FIG. 21, it is shown that the control thread 3 is arranged to urge only the float MD threads inwardly; however, the control thread 3 may be arranged in any form as long as it urges the float MD threads inwardly achieving its object. Thus, the control thread 3 may be arranged such that it urges both the MD threads, which are urged inwardly by the CD thread 11 or the CD thread 12, and the float MD threads.

Such an example will be described referring to FIG. 22. In this example, both the float MD threads 23A and 24A and the MD thread 22A which is urged inwardly by the CD thread 12 are urged inwardly by the control thread 3.

This arrangement also can place the root portions of the loops L at a stable position.

In this case, it is preferable to arrange such that the control thread 3 inwardly urges the MD thread 22A which is urged inwardly by the CD thread 12 rather than the MD thread 21A which is inwardly urged by the CD thread 11 placed at an extreme end because the MD thread 22A is held by the side surface of the CD thread 11 while its top surface is urged by the CD thread 12. Thus, even when a control thread is employed to inwardly urge the MD thread 22A, the MD thread 22A remains to be held by the side surface of the CD thread 11.

It is of course possible to make the control thread 3 inwardly urge a thread which is inwardly urged by the CD thread 11.

Figure 22:
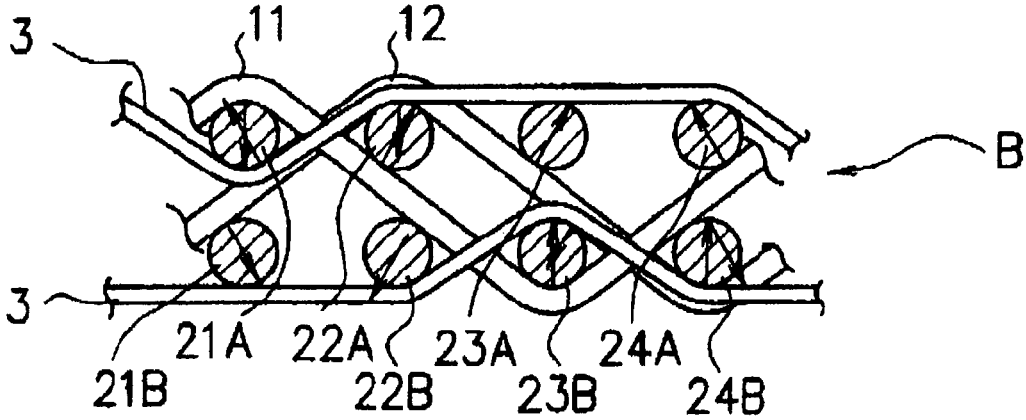

In FIGS. 21 and 22, an example is shown in which a control thread 3 comprised of a single thread is arranged in the CD direction in each surface layer.

However, in the present invention, the control thread 3 may consist of multiple threads to control the deviation in the outward direction and the CD direction.

Figure 23:
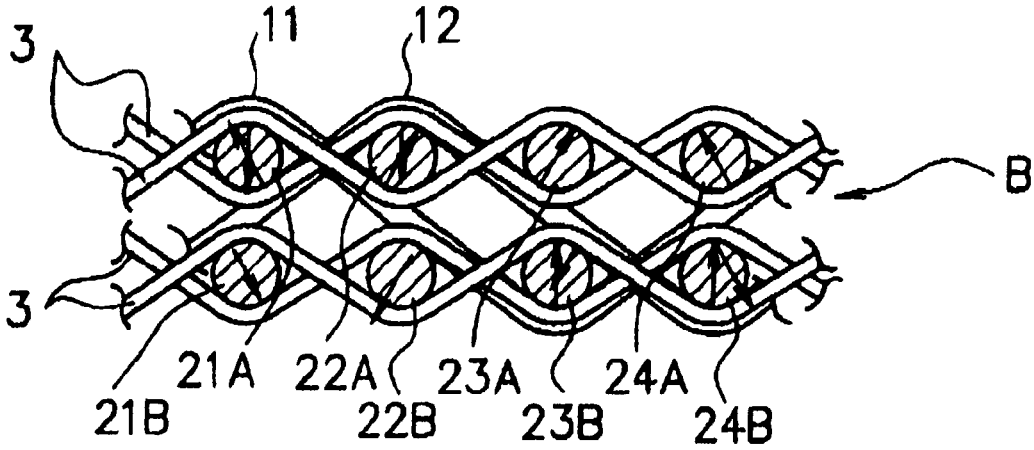

For example, as shown in FIG. 23, arrangement may be made such that one float thread MD 23A is urged inwardly by a first control thread 3 and likewise the other float MD thread 24A by a second control thread 3 respectively at an end of base fabric B.

That is, even when multiple control threads 3 are used, it is possible to stabilize the position of the root portions of the loops L if each of the multiple float MD threads is inwardly urged respectively.

In the above described examples in FIGS. 21 to 23, a control thread is separately disposed in each MD thread layer forming the surfaces of the base fabric; however, the control thread 3 may be disposed in any MD thread layer when, for example, the deviation of the roots of the loops L is not so large due to the factors such as the material and size of the CD thread 1 and the MD thread 2.

Also in FIGS. 21 to 23, a control thread is disposed separately in each MD thread layer forming the both surfaces of the base fabric B.

Figure 24:
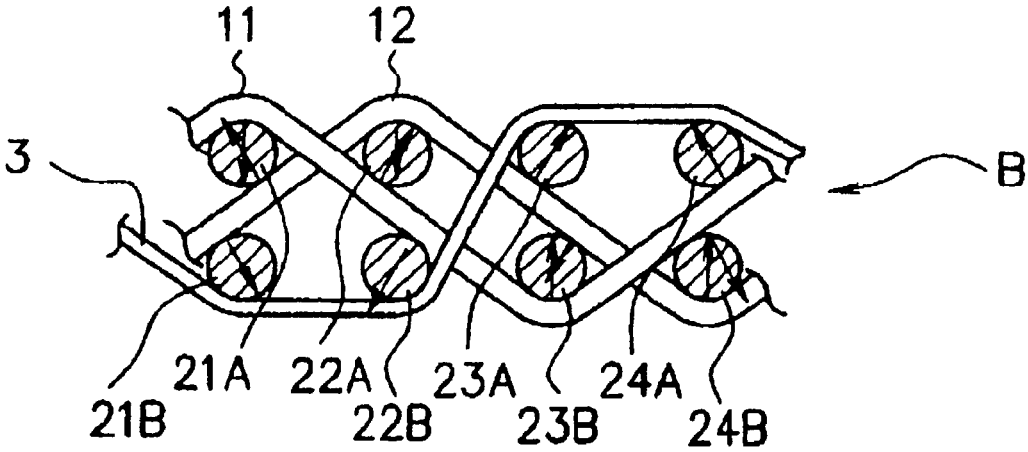

However, as shown in FIG. 24, the control thread 3 may also be disposed so as to connect each MD thread layer forming the both surfaces.

In this case, the control thread 3 consists of a single thread to inwardly urge the MD float threads 23A, 24A, 21B, 22B respectively.

Figure 25:
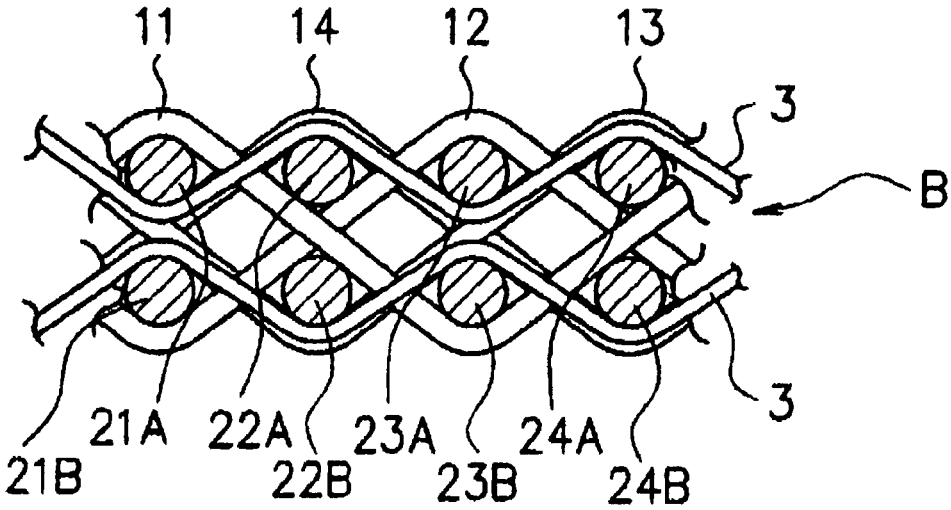
FIGS. 25 to 27 show cross sectional views in the CD direction of an end part of the second embodiment of the present invention.

Next, the second embodiment of the invention will be described referring to FIGS. 25 to 27. This embodiment is a practical example to improve the drawbacks of the ⅓ warp double weaving fabric described in FIGS. 11 to 14.

The control thread 3 is to urge the float MD threads which deviate mainly in the outward direction as in the case of the first embodiment.

Figure 26:
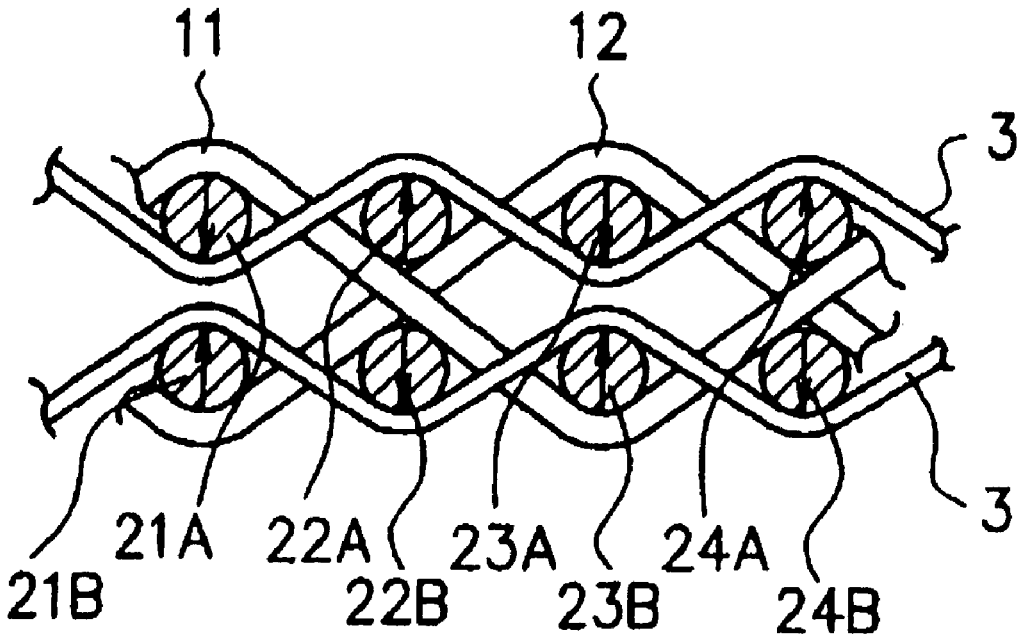

For example, as shown in FIG. 26, it may be configured such that a control thread 3 is disposed separately in each MD thread layer which forms the both surfaces of the base fabric B.

Figure 27:
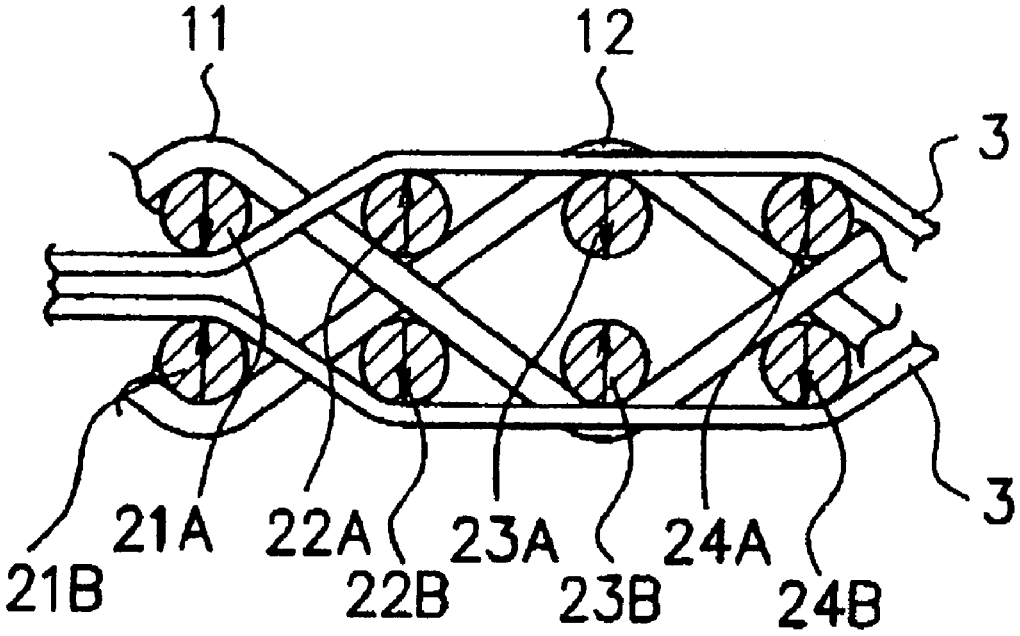

Also as shown in FIG. 27, another configuration may be adopted in which control thread 3 urges the MD threads including threads other than float MD threads.

Next, the control thread to correct the deviation in the CD direction of a MD thread near its loop will be described. In this case, the control thread is preferably adapted to cancel the force vector exerted by the CD threads and acting on the MD threads in the CD direction near the both ends thereof.

Figure 28:
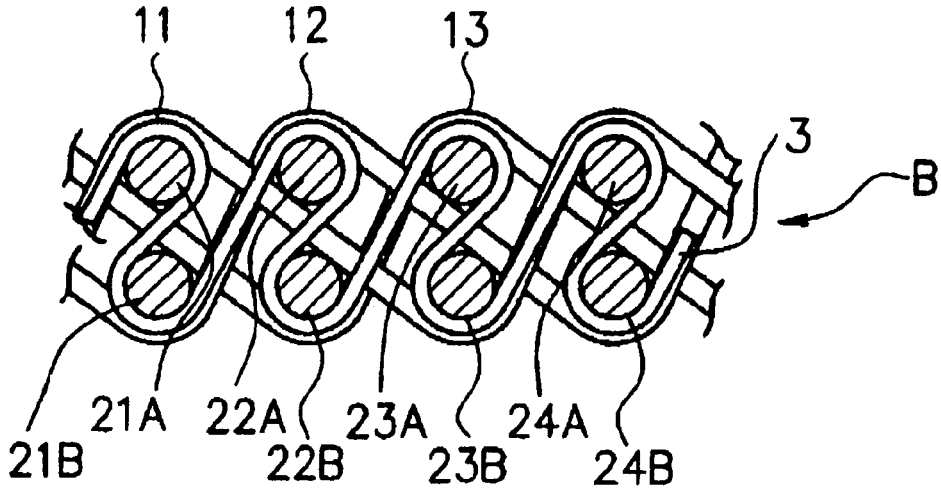
FIGS. 28 to 30 show cross sectional views in the CD direction of an end part of the third embodiment of the present invention.

From here on, the third embodiment will be described referring to FIGS. 28 to 30.

In this embodiment, the control thread 3 is to be arranged to cancel the force vectors exerted by the CD threads and acting on the MD threads in the CD direction at the root portions of the loops L.

Figure 17:
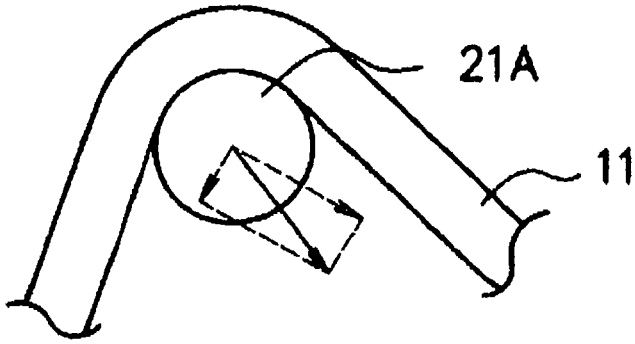
Figure 18:
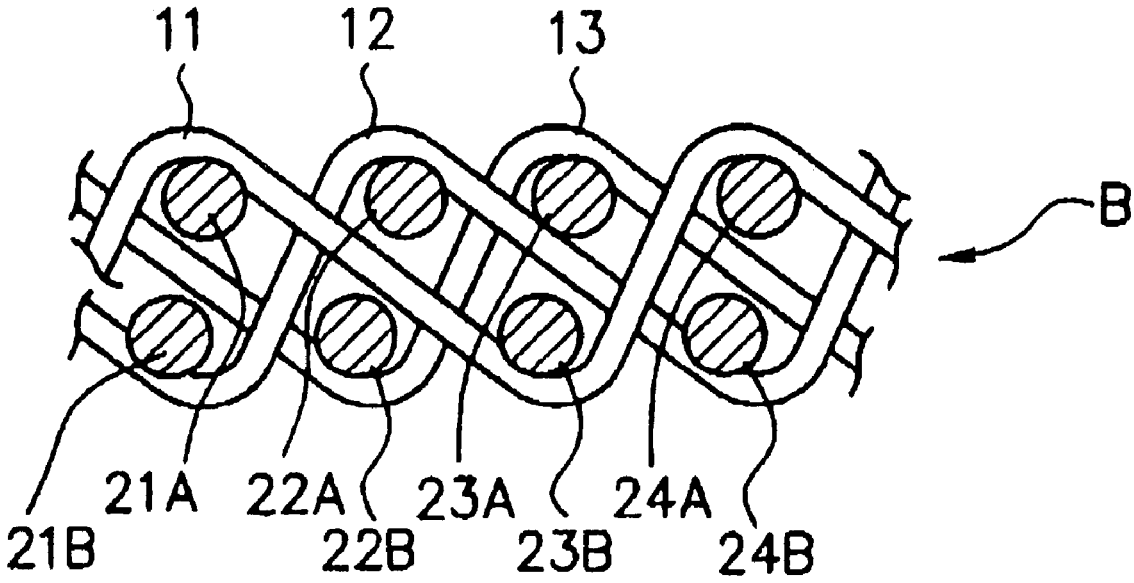
Figure 19:
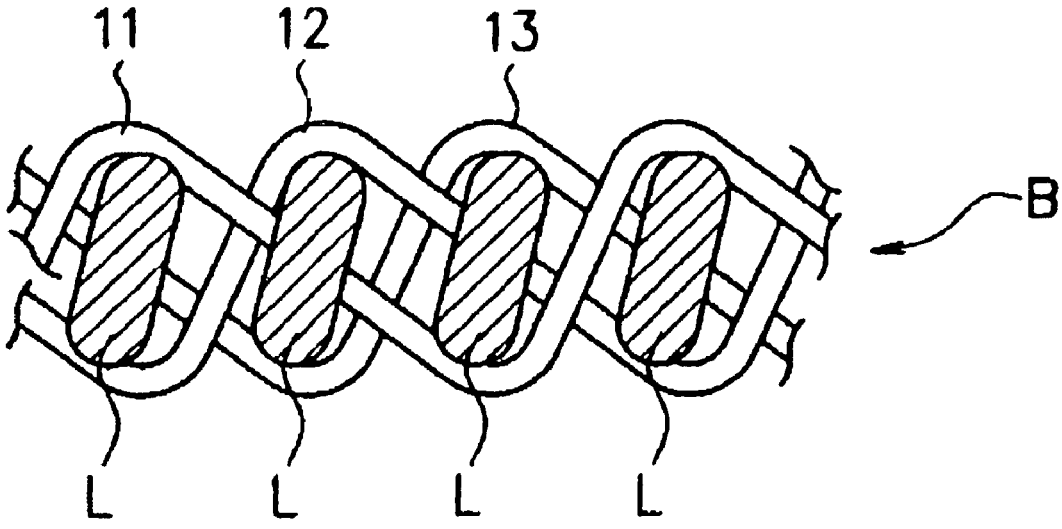
Figure 20:
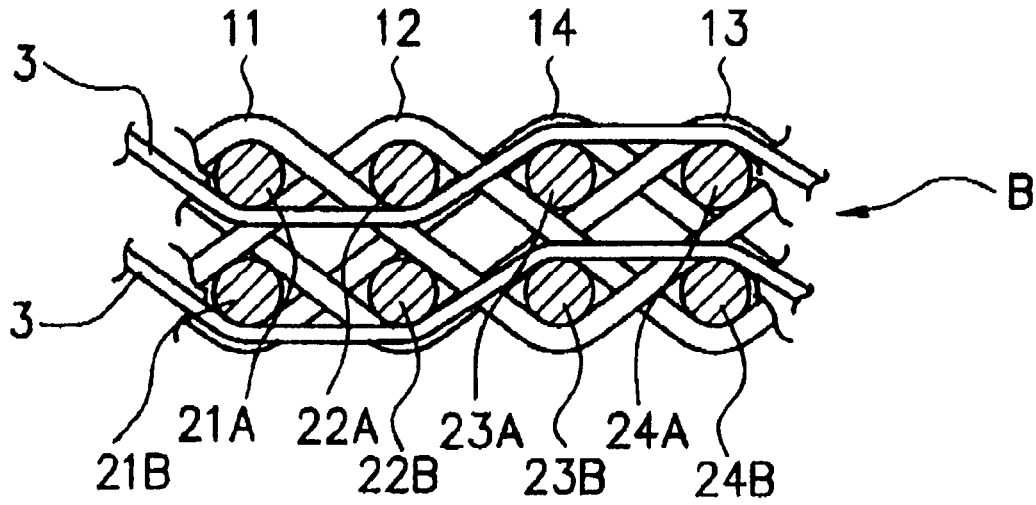
FIGS. 20 to 24 show cross sectional views in the CD direction of an end part of the first embodiment of the present invention.
Figure 29:
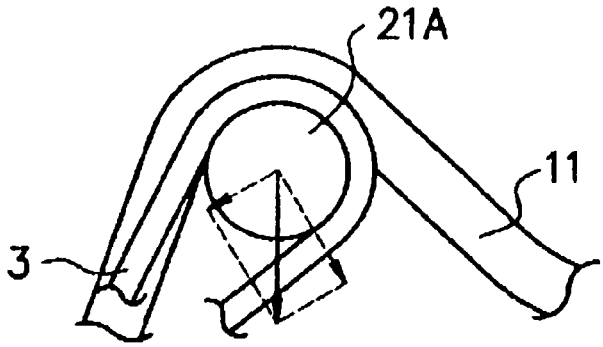
Figure 30:
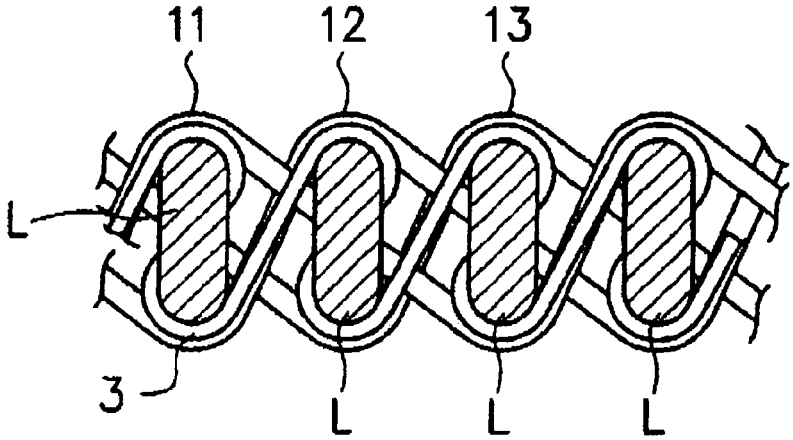

Referring to FIG. 29, which corresponds to the part described in FIG. 17, there is shown force vectors exerted by the control thread 3 and acting on the MD thread 21A.

That is, the control thread 3 urges the MD thread 21 to be subject to the force vectors in the CD direction and in the inward direction. Thus, the control thread 3 is to exert a force in the direction opposite to the urging direction of the CD thread 21.

The force vector exerted by the control thread 3 acts on all the MD threads. By this configuration, the disposition of the seam loops L is stabilized as shown in FIG. 30, and thereby a smooth operation during the engagement of the seam loops is achieved.

In disposing a control thread 3 in the base fabric B, control thread 3 is selected as a warp thread of a double-weaving loom for manufacturing. In this case, an independent heddle is exploited which is different form the one for the other CD threads 1 and is independently driven to make it possible to interweave the control thread in a different weave pattern from that of the other CD threads 1.

Though the control thread 3 may be selected from any type of material/structure, it is preferable to use a thread which is thinner than the CD thread 1. When a thread thinner than the CD thread 1 is used, the control thread will not appear at a position higher than the surface of a CD thread which urges the surface of the MD threads. This is preferable since the problems of transcription and vibration against the wet paper may be avoided.

Also a tow, which has a collective structure of non-stranded fiber, is preferably used as the control thread 3, because it flattens in a portion where it is bent.

When the control thread 3 is provided separately for each MD thread layer, a thread with a different size may be used for each MD layer.

Figure 2:
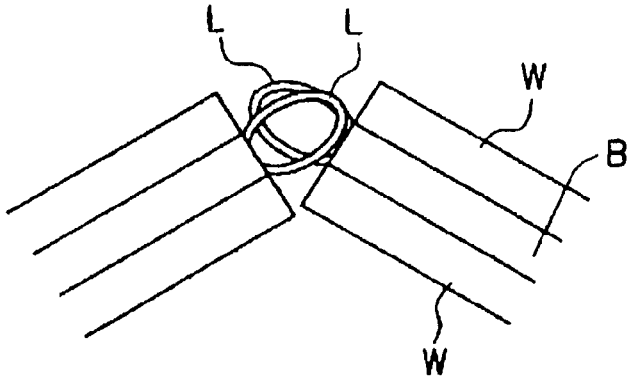
FIGS. 2 (A) and (b) show an engaging operation of ends of an open-ended papermaking press felt.
Figure 2:
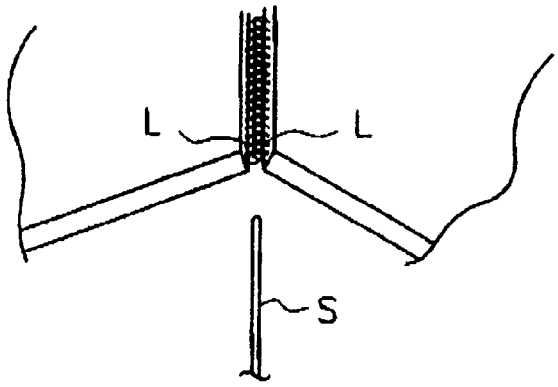
Figure 3:
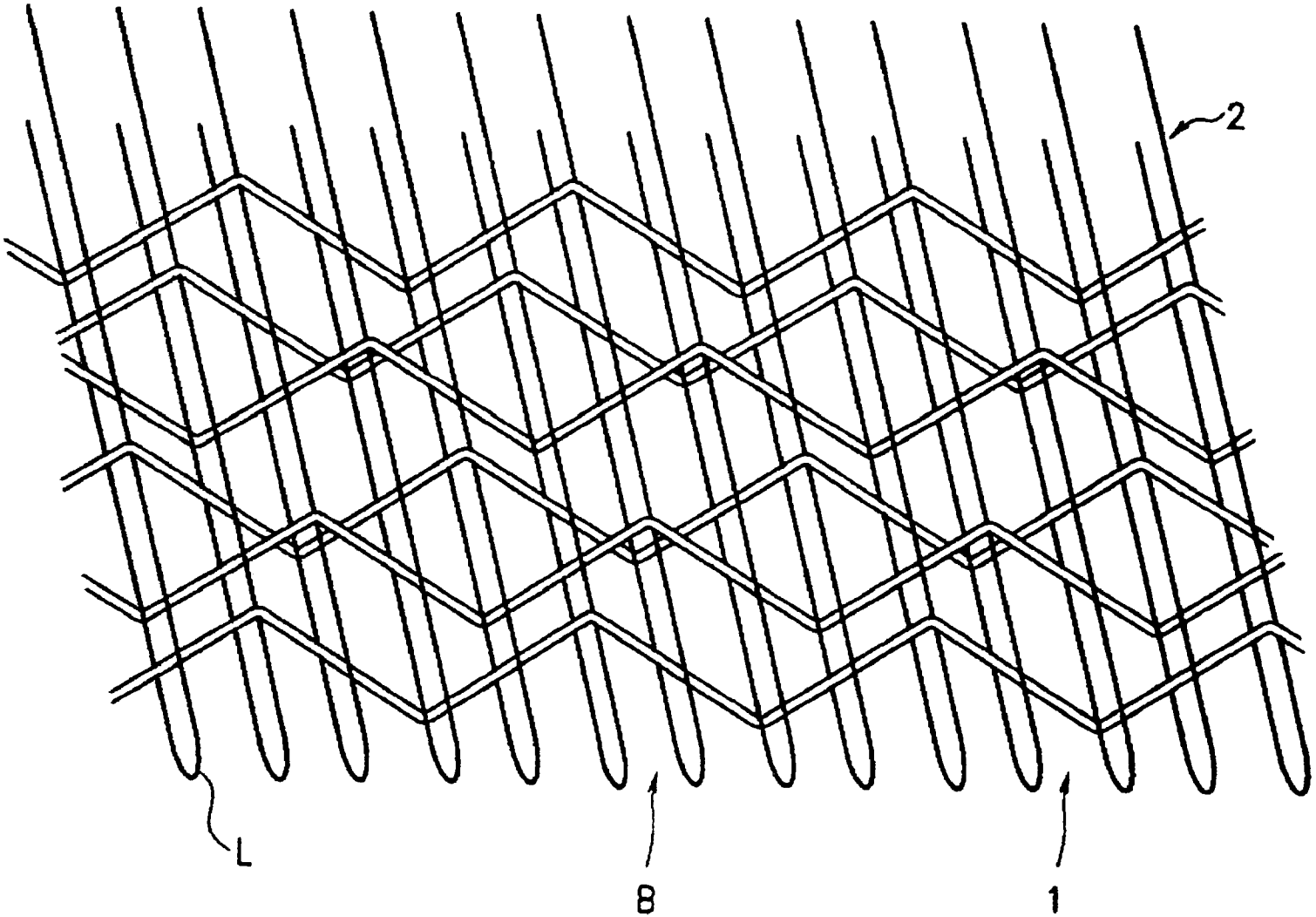
FIGS. 3 and 4 show a schematic view of an end part of a base fabric for an open-ended papermaking press felt.
Figure 4:
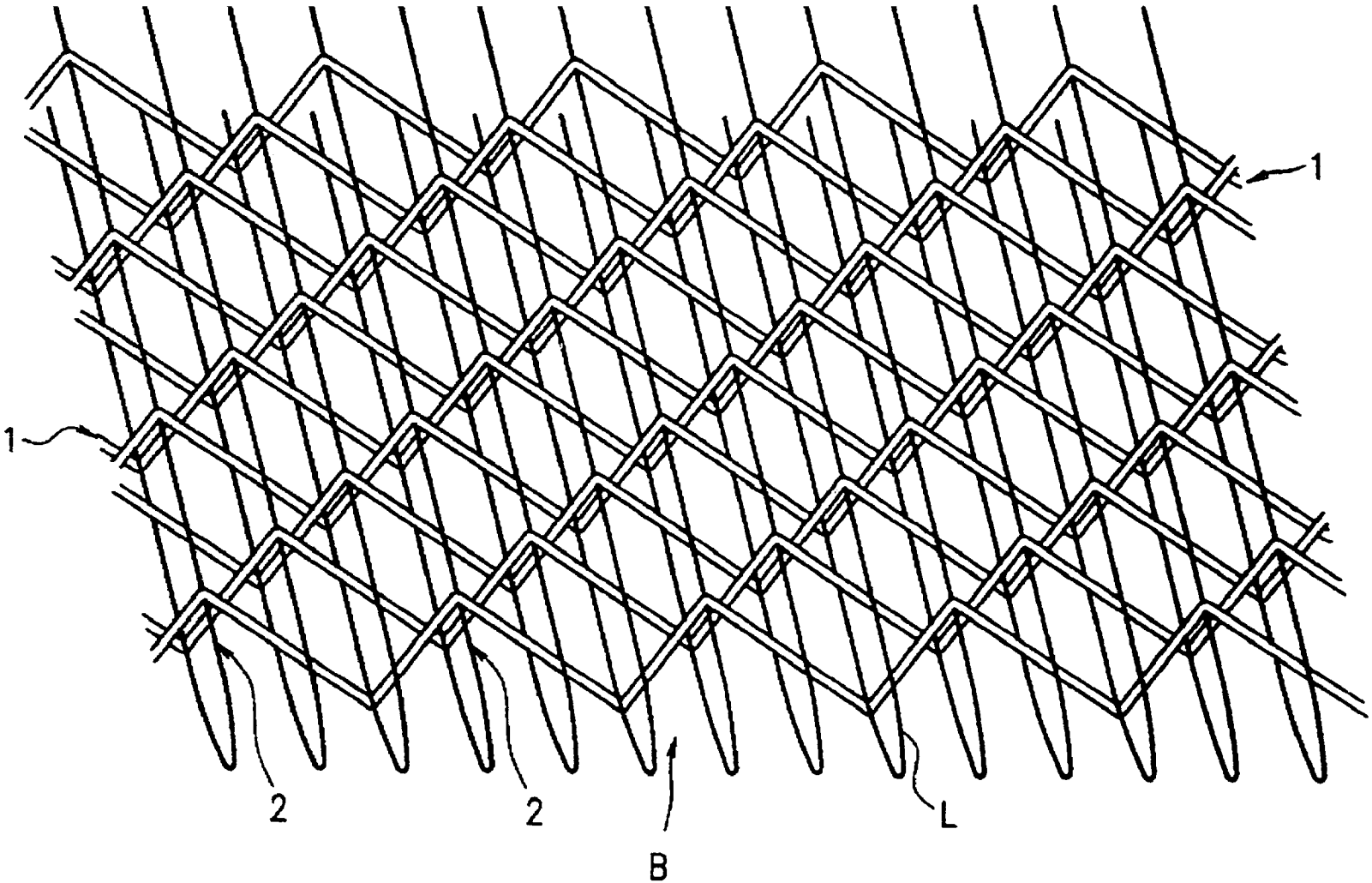
Figure 5:
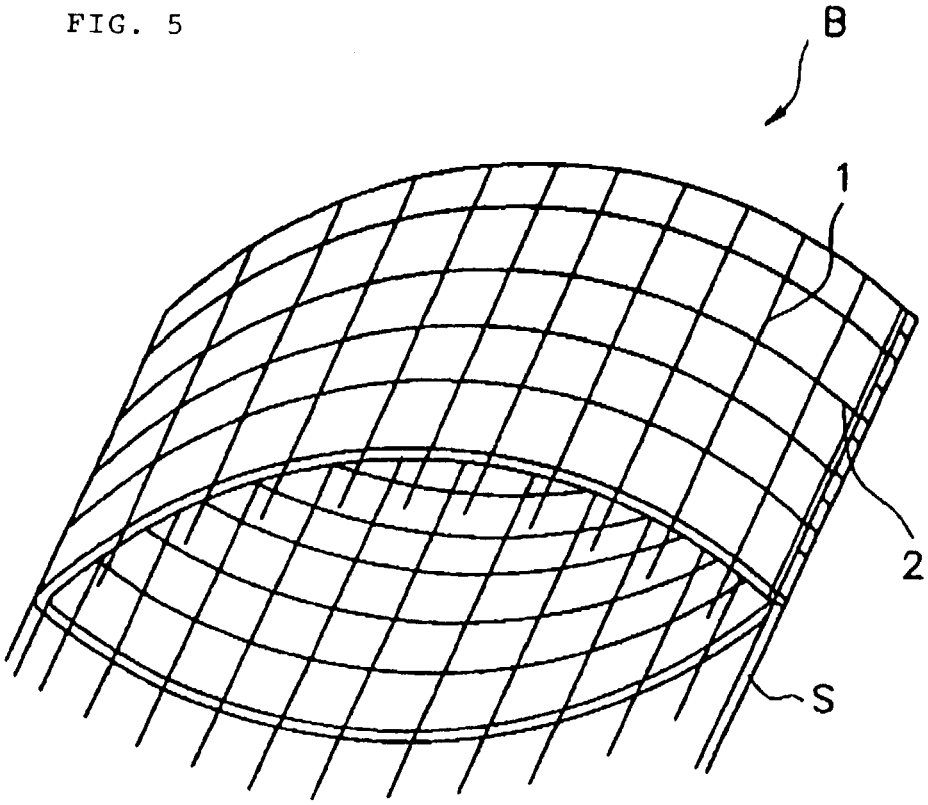
FIG. 5 is a schematic diagram to show the manufacturing process of the base fabric.
Figure 6:
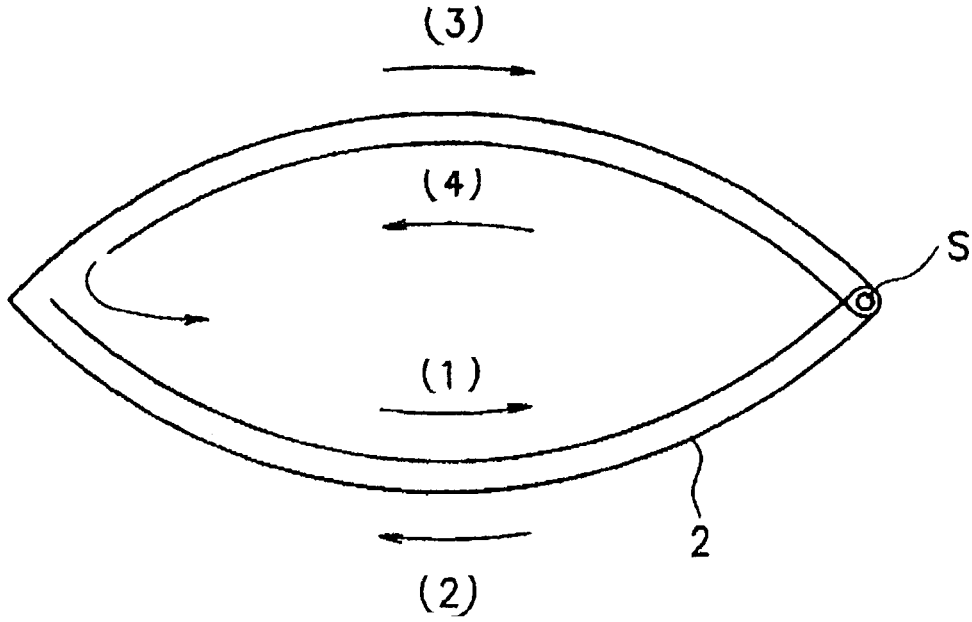
FIG. 6 is schematic diagram to show the travel sequence of the shuttle in weaving the base fabric.
Figure 7:
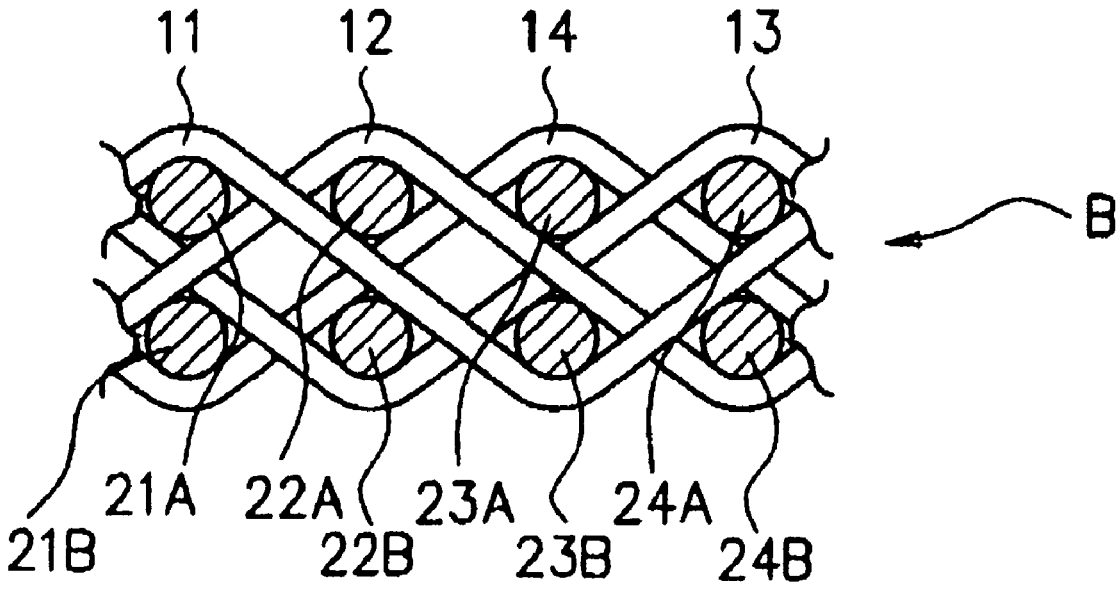
FIGS. 7 to 9 show cross sectional views in the CD direction of an end part of the base fabric of a first prior art example.
Figure 8:
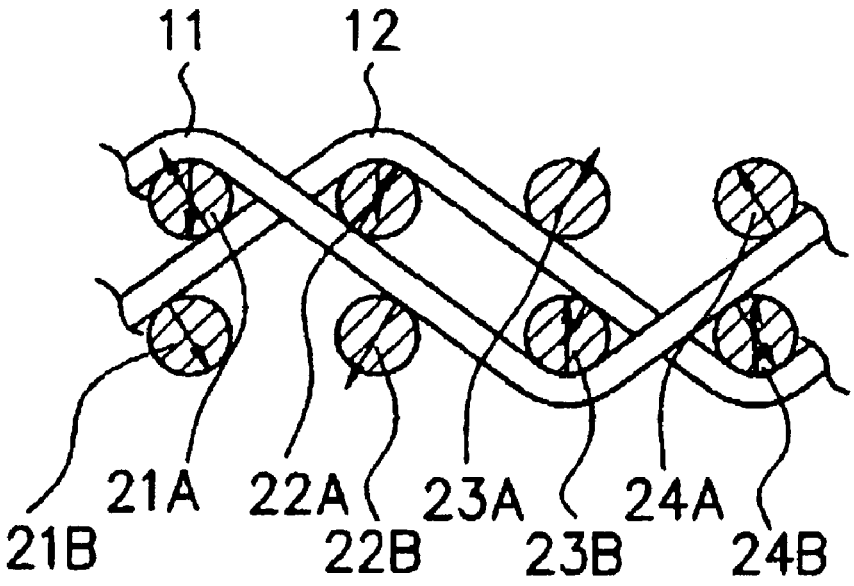
Figure 9:
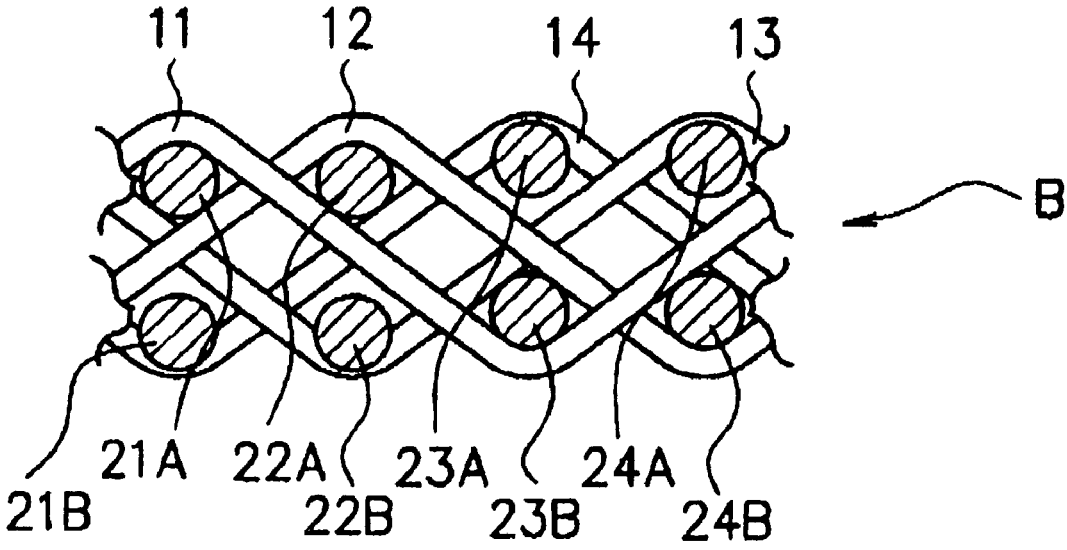
Figure 10:
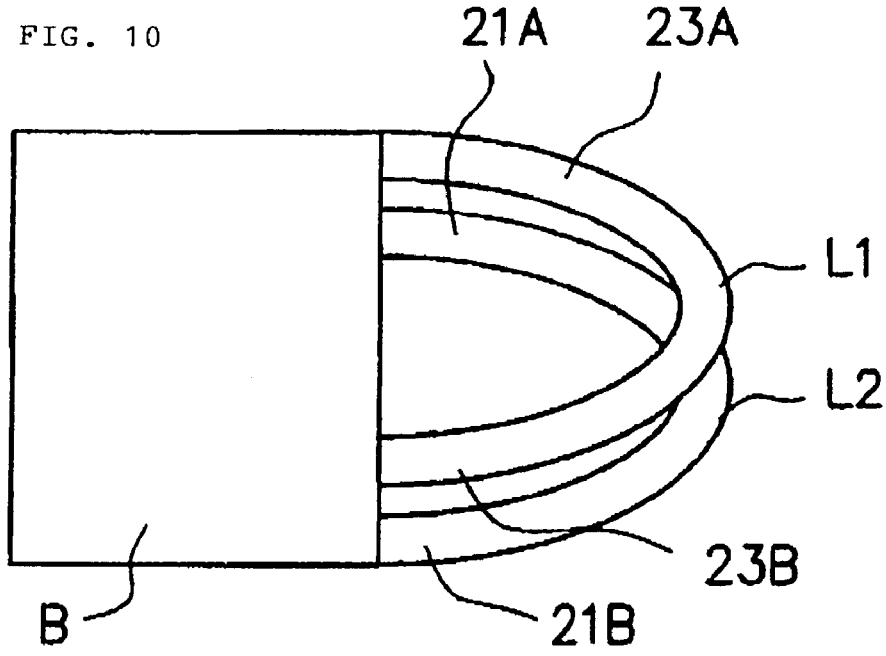
FIG. 10 shows a cross sectional views in the MD direction of an end part of the base fabric of a first prior art example.
Figure 11:
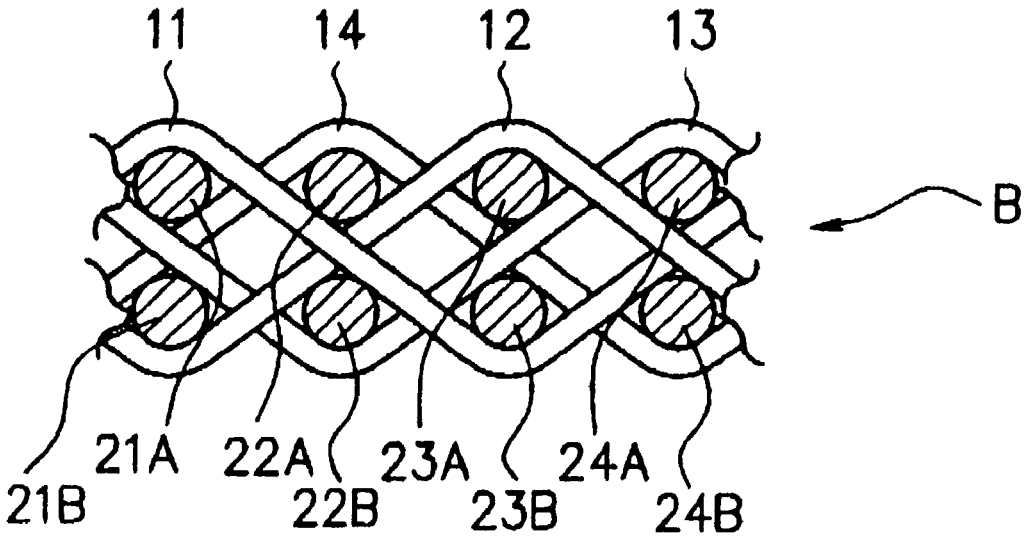
FIGS. 11 to 13 show cross sectional views in the CD direction of an end part of the base fabric of a second prior art example.
Figure 12:
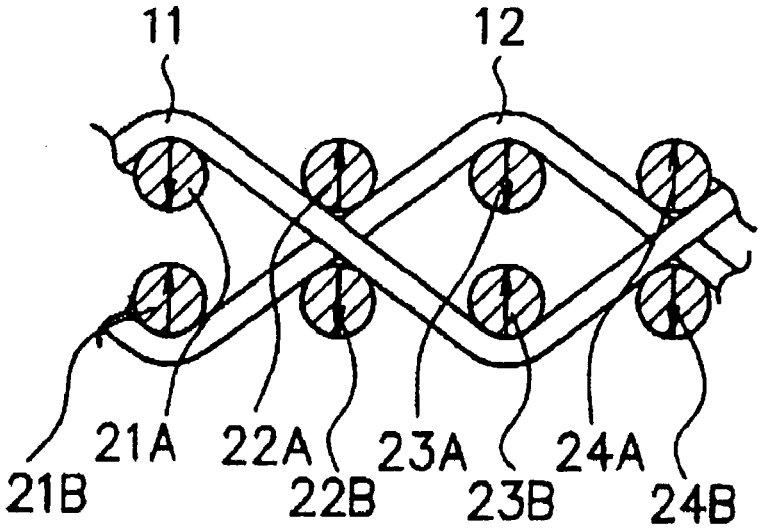
Figure 13:
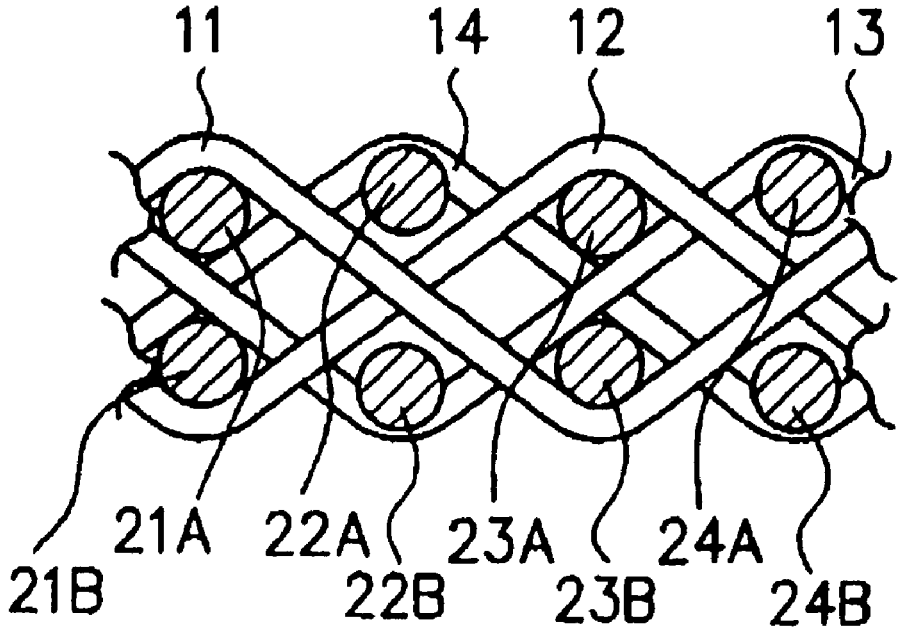
Figure 14:
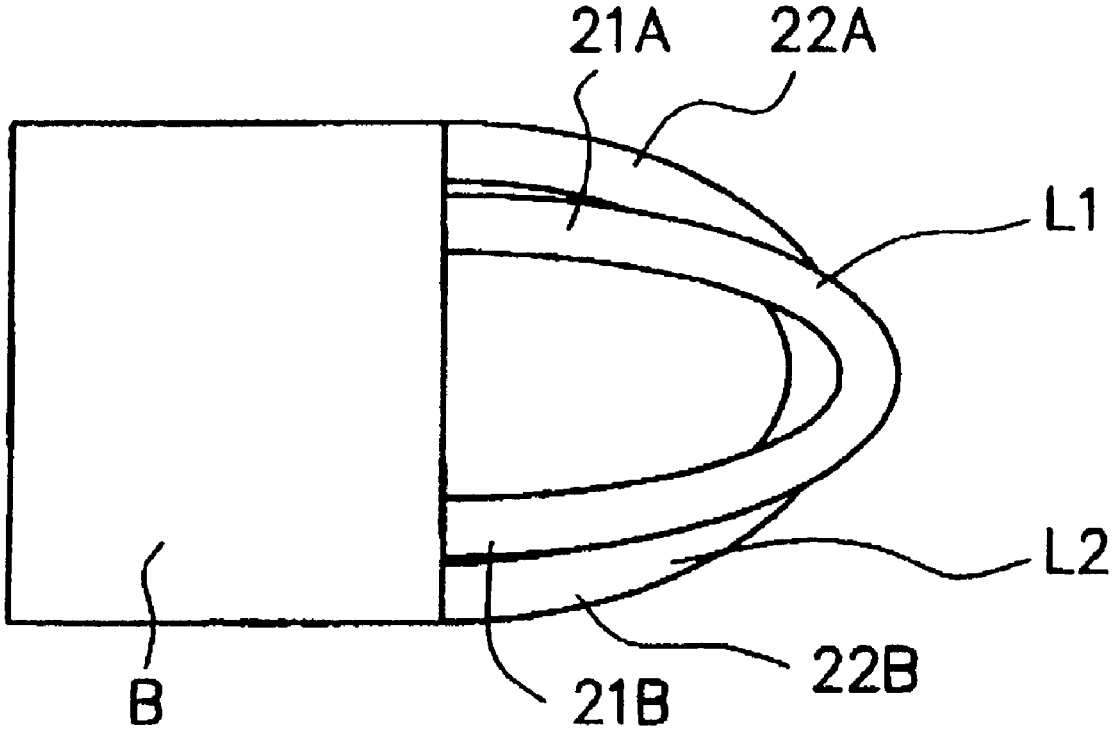
FIG. 14 shows a cross sectional views in the MD direction of an end part of the base fabric of a second prior art example.
Figure 15:
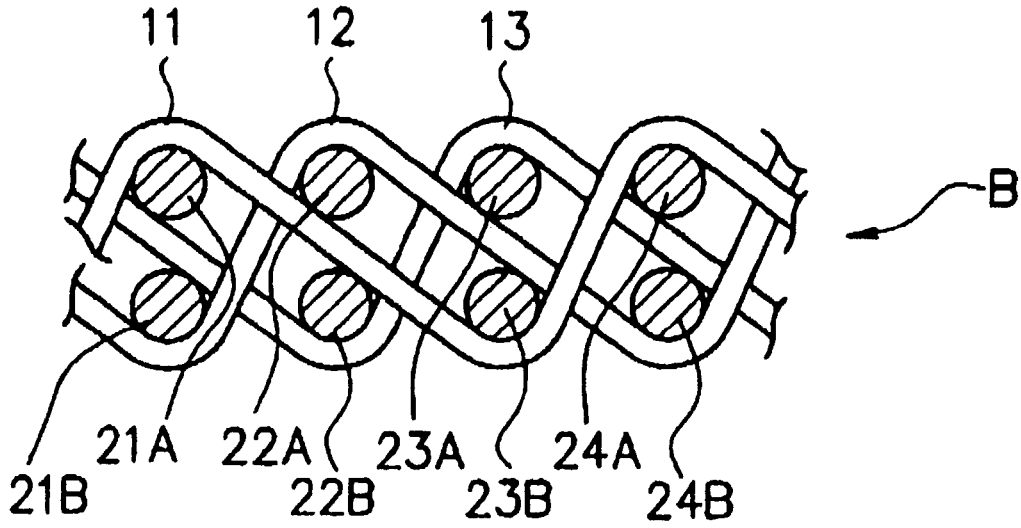
FIGS. 15 to 19 show cross sectional views in the CD direction of an end part of the base fabric of a third prior art example.
Figure 16:
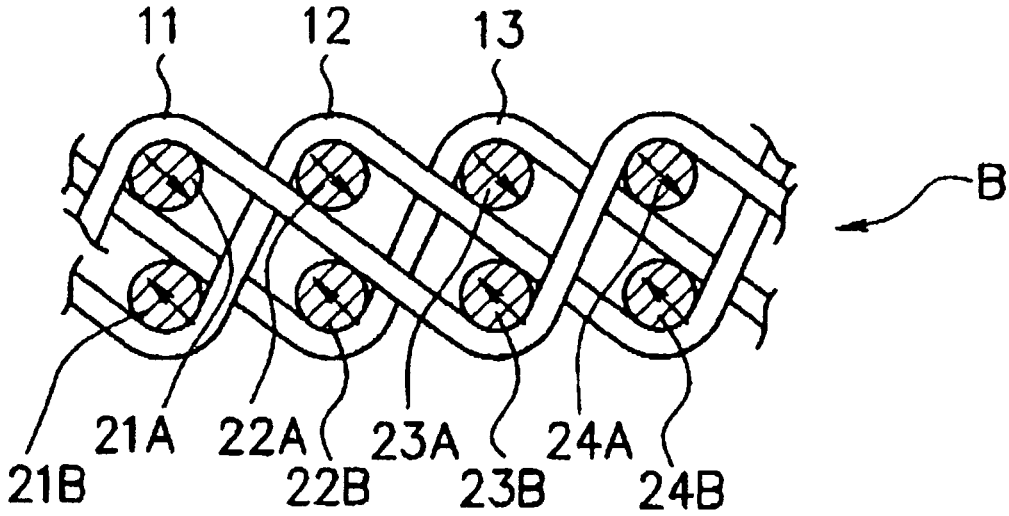

For example, the joining of the loops L at both ends is performed by bringing the two ends of open-ended felt into contact at an angle as shown in FIG. 2(A). At this moment, the engagement of the both loops becomes easier if a thicker thread is chosen for the control thread 3 placed on the topside of the root portion of a loop, and a thinner thread for the control thread 3 placed in the opposite side of the root portion of the loop.

This is because the engaging operation is performed by fitting the underside of a loop L at one end into between the topsides of two loops at the other end. Thus, selecting a thinner control thread for the underside of the loop facilitates the fitting operation, and therefore is preferable.

Figure 31:
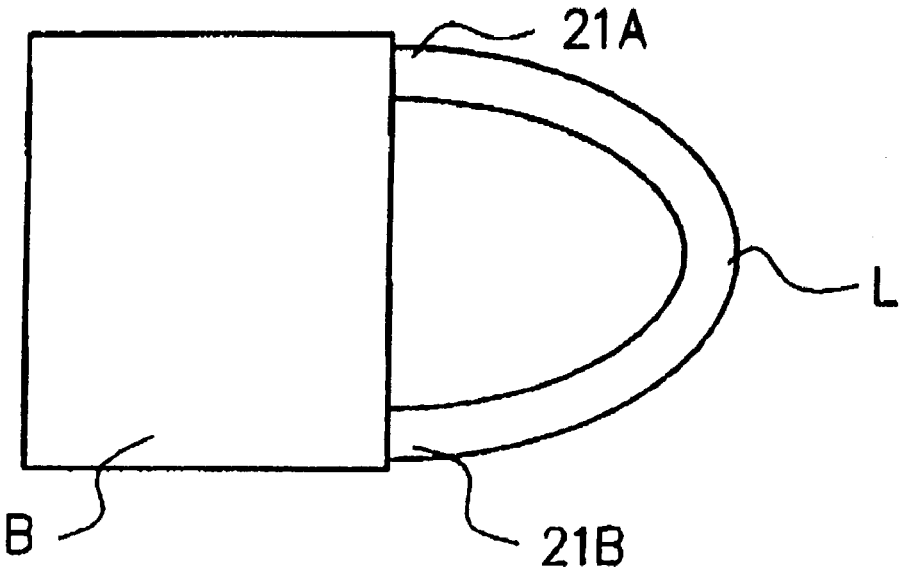
FIG. 31 shows a side view of the loop portion of the base fabric of the present invention.

According to the present invention, the shape of the loop is retained as shown by the side view in FIG. 31 by holding the root portion of a loop at a predetermined position by using the control thread 3 as an additional thread to the CD threads, and therefore the operations of engaging the loops and inserting the seam thread S are facilitated.

EXAMPLES

From here on, a papermaking press felt which utilizes the open-ended base fabric of the present invention will be described in more detail by using examples, but these are not intended to limit the present invention.

Examples A-1, A-2, B and comparative samples A, B for the papermaking press felt were prepared by using the MD thread, the CD thread, the batt layer, and the control thread shown in

TABLE 1

| | |
|---|---|
| MD thread | Material: Nylon6, thickness: 1000d, type: monofilament |
| CD thread | Material: Nylon6, thickness: 1320d, type: monofilament |
| Batt layer of both surfaces of the base fabric (short fiber) | Material: Nylon66, thickness: 20dtex |
| Control thread | Material: Nylon6, thickness: 40d, type: a crimped tow composed of 40 fibers of the same material. |

Example A-1

Figure 32:
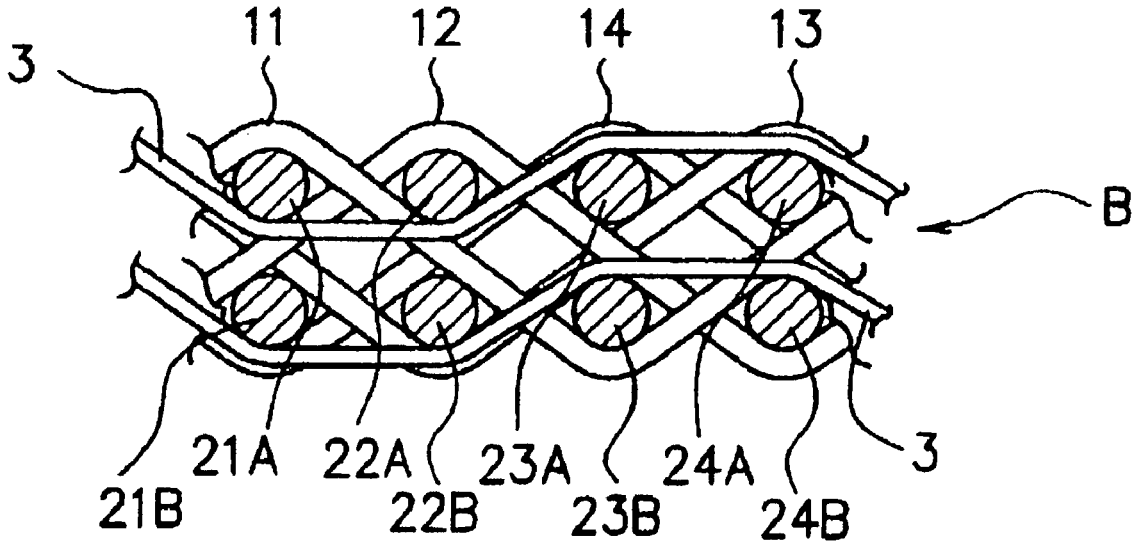
FIG. 32 shows a cross sectional view in the CD direction of an end part of the base fabric of the example A-1.

As the example A-1, a papermaking press felt was prepared which had a separate control thread for each MD thread layer as shown in FIG. 32 to exert a force against the deviation of the MD thread in the outward direction.

Example A-2

Figure 33:
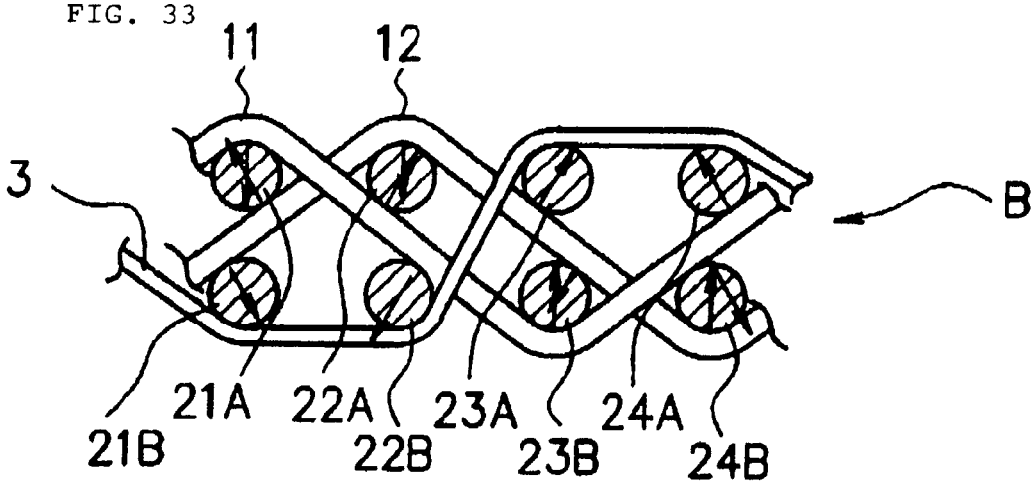
FIG. 33 shows a cross sectional view in the CD direction of an end part of the base fabric of the example A-2.

As the example A-2, there was prepared a papermaking press felt which had the same weave pattern of the CD threads with that of the example A-1 and was provided with a control thread, which exerts a force against the deviation in the outward direction of the MD thread, to connect each MD thread layer as shown in FIG. 33.

Comparable Sample A

Figure 34:
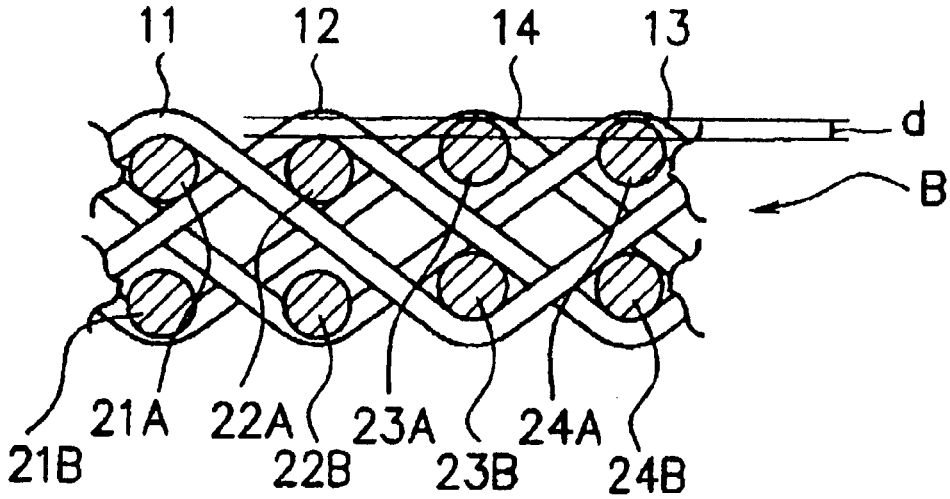
FIG. 34 shows a cross sectional view in the CD direction of an end part of the base fabric of the comparative sample A.

As the comparable sample A, there was prepared a papermaking press felt of which weave pattern was the same as the CD threads of the example A-1 and which had no control thread as shown in FIG. 34.

Example B

Figure 35:
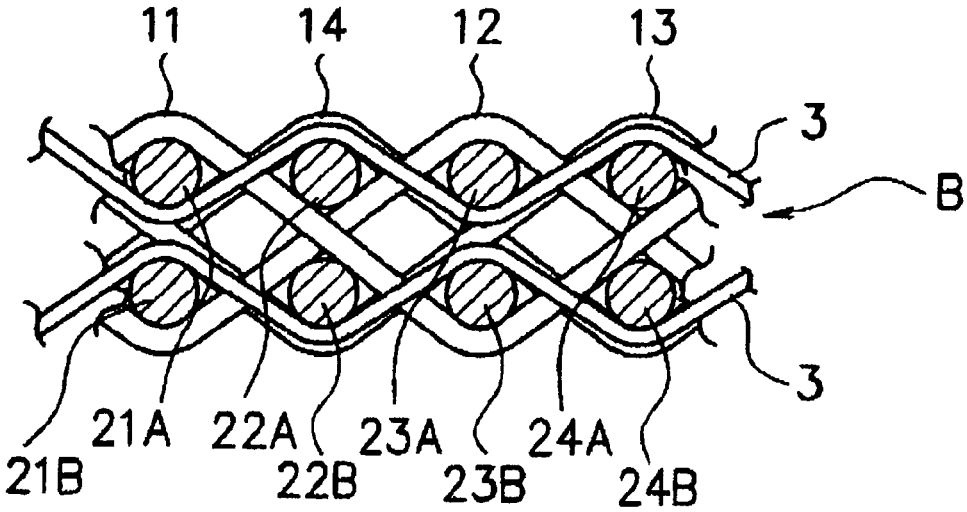
FIG. 35 shows a cross sectional view in the CD direction of an end part of the base fabric of the example B.

As the example B, a papermaking press felt was prepared which had a separate control thread for each MD thread layer as shown in FIG. 35 to exert a force against the deviation of the MD thread in the outward direction.

Comparable Sample B

Figure 36:
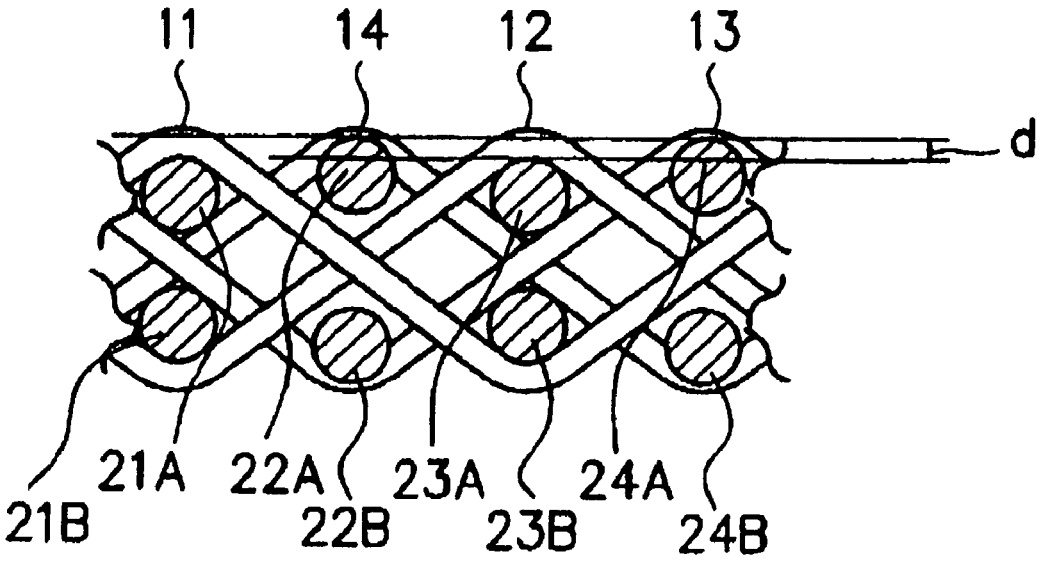
FIG. 36 shows a cross sectional view in the CD direction of an end part of the base fabric of the comparative sample B.

As the comparable sample B, there was prepared a papermaking press felt of which weave pattern was the same as the CD threads of the example B and which had no control thread as shown in FIG. 36.

Example C and comparative sample C for the papermaking press felt were prepared by using the MD thread, the CD thread, the batt layer, and the control thread shown in Table 2.

TABLE 2

| | |
|---|---|
| MD thread | material: Nylon6, thickness: 1000d, type: monofilament |
| CD thread | material: Nylon6, thickness: 1000d, type: twisted monofilament |
| Batt layer of both surfaces of the base fabric (short fiber) | material: Nylon66, thickness: 20dtex |
| Control thread | material: Nylon6, thickness: 40d, type: a crimped tow composed of 40 fibers of the same material. |

Example C

Figure 37:
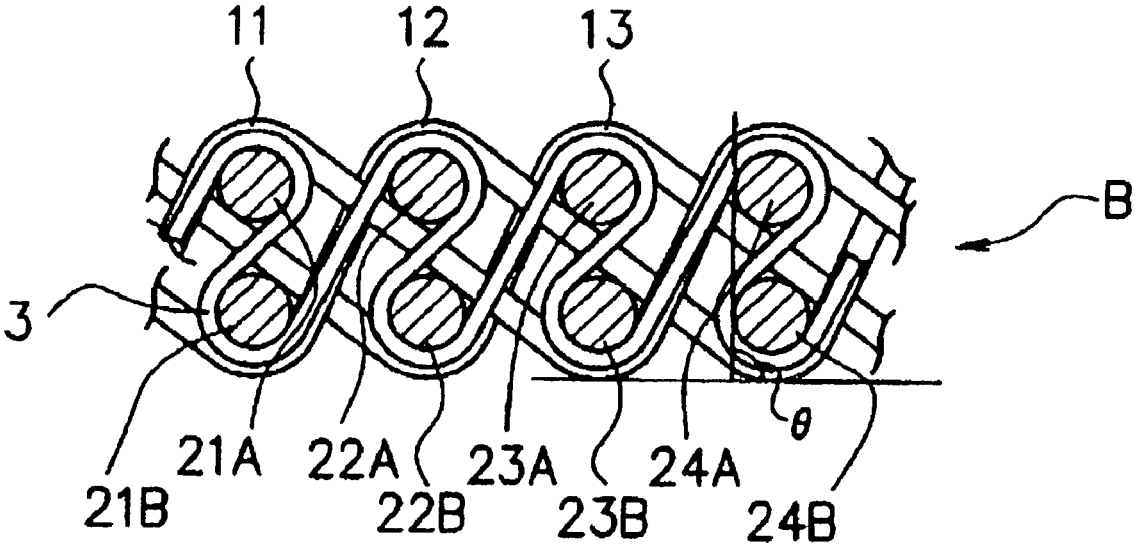
FIG. 37 shows a cross sectional view in the CD direction of an end part of the base fabric of the example C.

As the example C, a papermaking press felt was prepared which had a control thread to exert a force against the deviation of the MD threads in the CD direction as shown in FIG. 37.

Comparative Sample C

Figure 38:
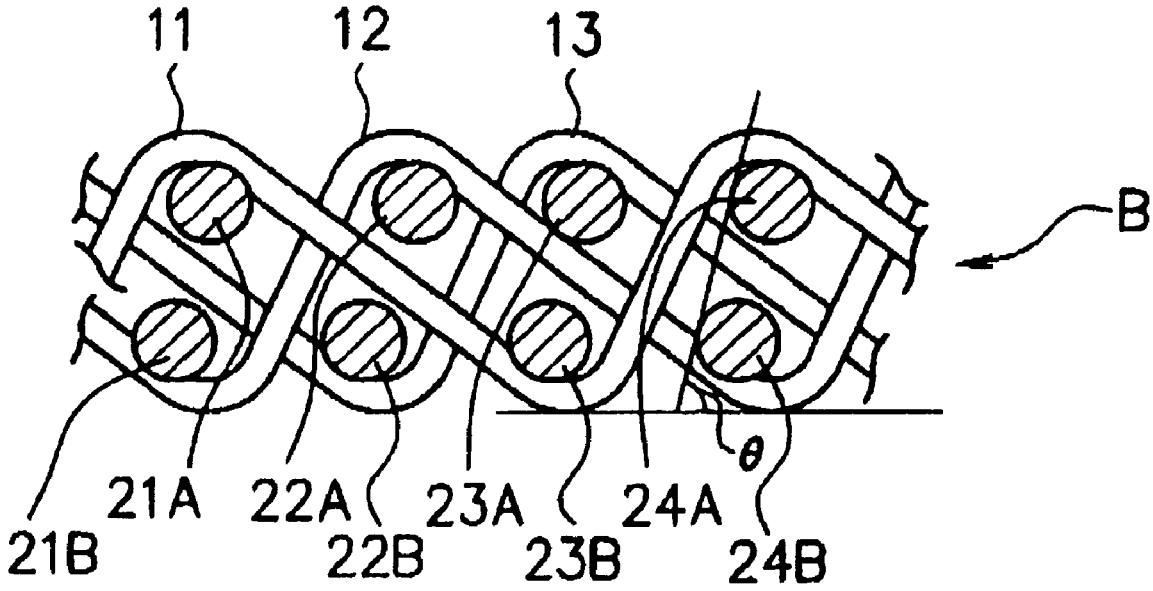
FIG. 38 shows a cross sectional view in the CD direction of an end part of the base fabric of the comparative sample C.

As the comparative sample C, a papermaking press felt was prepared which had the same weave pattern of the CD threads as that of the example C, but had no control thread as shown in FIG. 38.

There are shown measurement results of the deviation of the loop in the outward direction on the examples A-1, A-2, B and samples A, B. The deviation of the loop was determined by the positional difference between the head portion of the MD thread which deviated most in the outward direction and the head portion of MD thread which located at a predetermined position (see FIGS. 34 and 36).

TABLE 3

| Sample | Example A-1 | Example A-2 | Example B | Comparative sample A | Comparative sample B |
|---|---|---|---|---|---|
| Loop deviation (mm) | None | None | About 0.07 | About 0.15 | About 0.15 |

The slope of the loop was measured on the example C and the comparative sample C, and the results revealed that the slope was 87 degrees for the press felt of the example C and 76 degrees for the press felt of the comparative sample C. A slope of the loop indicates the deviation of the MD thread in the CD direction and is determined by the angle between the line which connects the centers of a pair of MD threads forming a loop and the line parallel with the both surfaces (see FIGS. 37 and 38).

The results confirmed that each example of the press felt of the present invention is able to retain the loop portions of the loops L at a predetermined position by incorporating a control thread as an additional thread at an end of the CD thread arrangement.

ADVANTAGES OF THE INVENTION

According to the present invention, a papermaking press felt is provided in which the shape of the seam loop is well maintained thus remarkably facilitating the mounting of the press felt on the press roll by an operator.

The invention claimed is:

1. An open-ended base fabric for a papermaking press felt, comprising:

a continuous MD thread disposed in the MD direction on each layer constituting both surfaces of said base fabric; and CD threads in the CD direction interwoven with the MD thread to connect said each layer, said continuous MD thread forming a loop portion for inserting a seam thread at both ends of the base fabric, wherein said base fabric is provided with a control thread along each end edge of the CD thread arrangement, said control thread being a fiber which is thinner than the CD thread and/or a fiber which is flattened as it is bent, and interwoven in a different weave pattern from that of the CD thread in the base fabric, and said control thread urges the MD threads near the ends of the base fabric not to deviate in the outward direction and/or the CD direction so that the shape of said loop portion for inserting a seam thread is retained.

2. The open-ended base fabric for a papermaking press felt according to claim 1, characterized in that said control thread is arranged to inwardly urge a MD thread which is inwardly urged neither by a first CD thread located at an extreme end of the CD thread arrangement nor by a second CD thread adjacent to said first CD thread.

3. The open-ended base fabric for a papermaking press felt according to claim 1, characterized in that said control thread cancels out a force vector in the CD direction which is exerted by a CD thread and acts on a MD thread near both ends of the base fabric.

4. The open-ended base fabric for a papermaking press felt according to claim 1, characterized in that each control thread arranged separately for each layer has a different thickness.

5. The open-ended base fabric for a paper-making press felt according to claim 1, characterized in that said control thread is disposed in any of the layers of the MD thread.

6. The open-ended base fabric for a papermaking press felt according to claim 1, characterized in that said control thread is arranged to connect each layer of the MD thread.

7. The open-ended base fabric for a papermaking press felt according to claim 2, characterized in that said control thread is separately arranged for each layer of the MD thread.

8. The open-ended base fabric for a papermaking press felt according to claim 7, characterized in that each control thread arranged separately for each layer has a different thickness.

9. The open-ended base fabric for a paper-making press felt according to claim 7, characterized in that said control thread is disposed in any of the layers of the MD thread.

10. A papermaking press felt comprising the open-ended base fabric for a papermaking press felt according to claim 1.

11. An open-ended base fabric for a papermaking press felt, comprising:

a continuous MD thread disposed in the MD direction on each layer constituting both surfaces of said base fabric; and CD threads in the CD direction interwoven with the MD thread to connect said each layer, said continuous MD thread forming a loop portion for inserting a seam thread at both ends of the base fabric, wherein said base fabric is provided with a control thread along each end edge of the CD thread arrangement, said control thread being a fiber which is thinner than the CD thread and/or a fiber which is flattened as it is bent and, interwoven in a different weave pattern from that of the CD thread in the base fabric and separately arranged for each layer of the MD thread, and said control thread urges the MD threads near the ends of the base fabric not to deviate in the outward direction so that a shape of said loop portion for inserting a seam thread is retained.

12. The open-ended base fabric for a papermaking press felt according to claim 11, characterized in that said control thread is arranged to inwardly urge an MD thread which is inwardly urged neither by a first CD thread located at an extreme end of the CD thread arrangement nor by a second CD thread adjacent to said first CD thread.

13. The open-ended base fabric for a papermaking press felt according to claim 11, characterized in that each control thread arranged separately for each layer has a different thickness.

14. The open-ended base fabric for a papermaking press felt according to claim 11, characterized in that said control thread is disposed in any of the layers of the MD thread.

15. A papermaking press felt comprising the open-ended base fabric for a papermaking press felt according to claim 11.

* * * * *